United States Patent [19]

Makainai, Jr.

[11] 4,380,957

[45] Apr. 26, 1983

[54] FLARE WITH IMPROVED STARTER CAP

[76] Inventor: Jesse K. Makainai, Jr., 45-042 Kaneohe Bay Dr., Kaneohe, Hi. 96744

[21] Appl. No.: 189,749

[22] Filed: Sep. 23, 1980

[51] Int. Cl.[3] ..... F42B 3/18

[52] U.S. Cl. ..... 102/202.1; 102/205; 102/275.6; 102/275.12; 102/336

[58] Field of Search ..... 102/202.1, 205, 275.6, 102/275.12, 315, 469, 470, 336

[56] References Cited

U.S. PATENT DOCUMENTS

| | | | |
|---|---|---|---|
| 379,147 | 3/1888 | Andrews | 102/205 |
| 795,954 | 8/1905 | Brant | 102/275.6 |
| 932,077 | 8/1909 | Weyel et al. | 102/205 X |
| 968,188 | 8/1910 | McPhee et al. | 102/275.6 |
| 3,747,247 | 7/1973 | McNair | 102/470 X |
| 3,827,360 | 8/1974 | Geimer | 102/205 |
| 3,926,119 | 12/1975 | Hurst et al. | 102/315 X |
| 4,000,696 | 1/1977 | Friant et al. | 102/315 X |

*Primary Examiner*—Peter A. Nelson

*Attorney, Agent, or Firm*—Harvey B. Jacobson

[57] ABSTRACT

A fusee is provided including a tubular housing containing a pyrotechnic mixture and one end of the housing includes a match head defining an outwardly opening central cavity therein. A cover sleeve including a central partition therein is provided and defines opposite end outwardly opening recesses on opposite sides of the partition. A scratch mix central projection is supported within one of the recesses on the corresponding side of the partition and the cover sleeve is removably telescoped over the match head supporting end of the housing with that housing end telescoped into the other of the recesses. The cover sleeve is alternately telescopingly engageable over the match head supporting end of the housing with the match head end received in the scratch mix projection containing recess and in position with the projection frictionally telescoped into the cavity of the match head for igniting the same. The end of the sleeve containing the scratch mix projection has a removable cover releasably engaged therewith and includes structure releasably engageable with the match head for releasably limiting telescoping of the match head end of the housing sufficiently into the scratch mix projection containing recess sufficient to engage the projection in the match head cavity.

9 Claims, 7 Drawing Figures

FLARE WITH IMPROVED STARTER CAP

BACKGROUND OF THE INVENTION

Use of fusees in different situations is increasing and while persons previously using fusees at least had some instruction or prior experience in the use thereof, many persons now having occation to use fusees are inexperienced in the use thereof and hesitate in effecting their use because of the dangers associated therewith. Most fusees requite two-handed operation for ignition with at least one hand positioned closely adjacent the ignition end of the fusee.

Accordingly, a need exists for an improved form of fusee including ignition means therefor which may be readily operated by even inexperienced persons in a safe manner.

Examples of various different forms of fusees and fusee ignition devices are disclosed in U.S. Pat. Nos. 2,807,208; 3,043,220; 3,528,370; 3,530,759; 3,628,416; 3,714,121; 3,827,360; 3,954,059 and 4,176,606.

BRIEF DESCRIPTION OF THE INVENTION

The fusee of the instant invention includes match head and ignition structure therefor enabling the fusee to be safely ignited, even by inexperienced persons. The fusee is somewhat conventional in design in that it includes an elongated housing having a pyrotechnic mixture therein and a match head on one end of the housing to be frictionally engaged with a scratch mix for igniting the match head and thus the pyrotechnic mixture.

However, the match head defines an ouwardly opening central cavity therein and the housing includes a closure sleeve having a central partition therein and including opposite end recesses on opposite sides of the central partition. One of the recesses is empty and may be telescoped over the match end of the housing during storage of the fusee prior to use. The other recess includes a scratch mixture central projection disposed therein supported from the central partition of the sleeve and which may be advanced into engagement with the cavity formed in the match head of the fusee as that end of the sleeve is telescoped over the match head supporting end of the fusee housing. Thus, initial ignition of the fusee occurs within the closure sleeve, the latter quickly burning away subsequent to initial fusee ignition.

The main object of this invention is to provide a fusee and ignition structure therefor enabling the fusee to be readily ignited in a safe manner, even by inexperienced person.

Another object of this invention is to provide a fusee in accordance with the preceding objects and including closure structure both for the match head thereof and the scratch mix prior to a period of intended usage of the fusee.

Yet another important object of this invention is to provide a fusee which otherwise may be constructed in conventional form, either with or without a stand or spike on the base end thereof.

A final object of this invention to be specifically enumerated herein is to provide a fusee in accordance with the preceding objects and which will conform to conventional forms of manufacture, be of simple construction and easy to use so as to provide a define that will economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
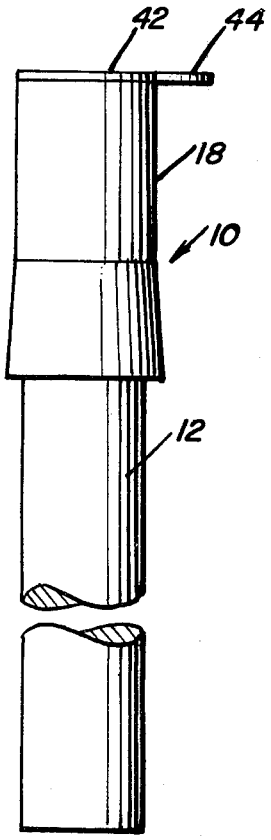
FIG. 1 is a side elevational view of a fusee constructed in accordance with the present invention and shown in a "closed" position, an intermediate portion of the fusee being broken away.
Figure 2:
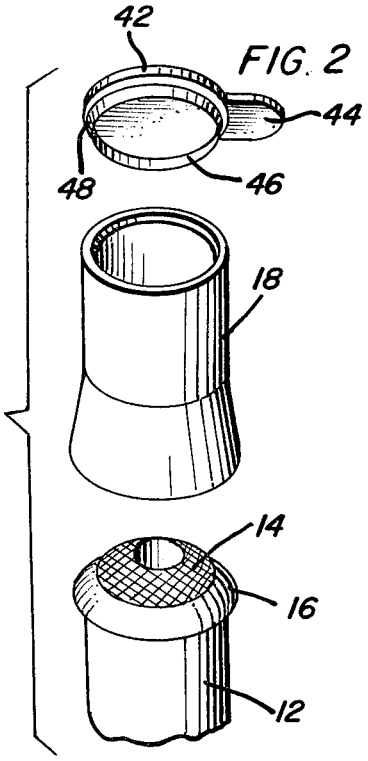
FIG. 2 is an exploded perspective view of the upper end of the fusee.

Referring now more specifically to the drawings, the numeral 10 generally designates a fusee constructed in accordance with the present invention. The fusee 10 contains a main cylindrical housing 12 having a quantity of pyrotechnic material (not shown) contained therein and provided with a match head 14 on one end for ignition of the pyrotechnic material within the housing 12. Of course, the housing 12 may be constructed of paper or other combustible material in order that the housing 12 may burn away as the pyrotechnic material burns, in the conventional manner of a fusee.

The fusee 10 additionally includes a circumferential transversely convex rib 16 extending about the end of the housing 12 from which the match head is supported and a closure sleeve 18 is provided and includes an inner central partition 20. The closure sleeve 18 defines opposite end recesses 22 and 24 therein on opposite sides of the partition 20 and which open in opposite directions outwardly of the opposite ends of the closure sleeve 18. The recess 22 includes corrugated side walls 26 defining circumferential inwardly projecting zones 28 and 30. In addition, the recess 22 defines an inwardly projecting shoulder 32 adjacent its inner end.

The recess 24 includes a central projection 34 supported on the partition 20 and having a scratch mix 36 disposed thereon. The projection 34 is tapered toward the open end of the recess 24 and the latter includes a circumferential inwardly projecting rib 38 intermediate the opposite ends of the recess 24 and outwardly of the projection 34 as well as an inwardly projecting circumferentially extending lip 40 at the outer end of the recess 24.

A removable cover 42 provided with laterally outwardly projecting integral lift tab 44 is provided and the cover 42 includes a reduced diameter portion 46 for telescoping into the open end of the recess 24 and including a circumferential groove 48 in which the lip 40 of the cover 42 may be snap fittingly engaged in order to releasably retain the cover in closing postion over the end of the cover sleeve 18 provided with the projection 34.

Figure 3:
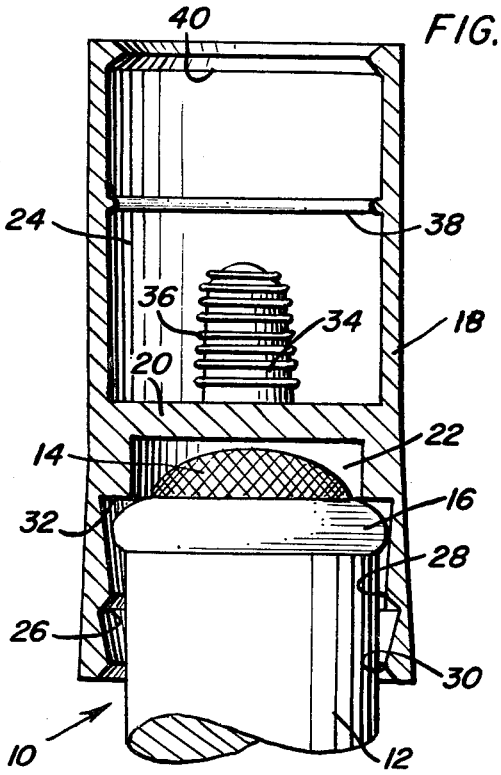
FIG. 3 is an enlarged fragmentary vertical sectional view of the upper end of the fusee with the cover or the closure sleeve removed.
Figure 4:
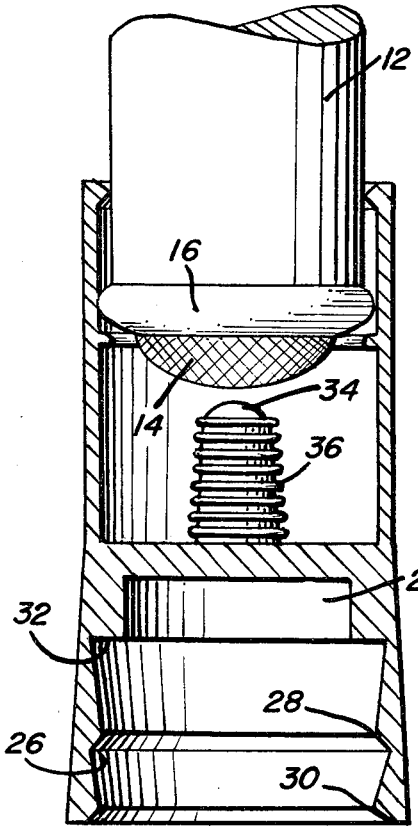
FIG. 4 is a fragmentary vertical sectional view of the fusee immediately prior to ignition of the match head and pyrotechnic mixture.
Figure 5:
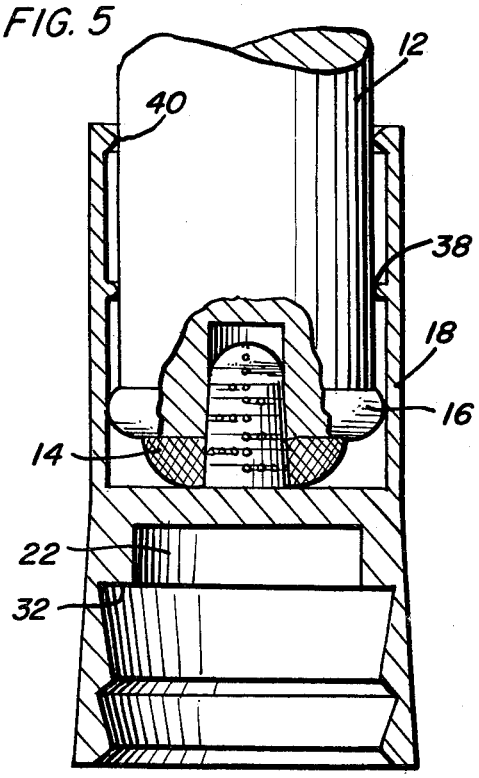
FIG. 5 is a fragmentary vertical sectional view similar to FIG. 4 illustrating the scratch mix projection in frictional engagement with the match head for ignition of the same.
Figure 6:
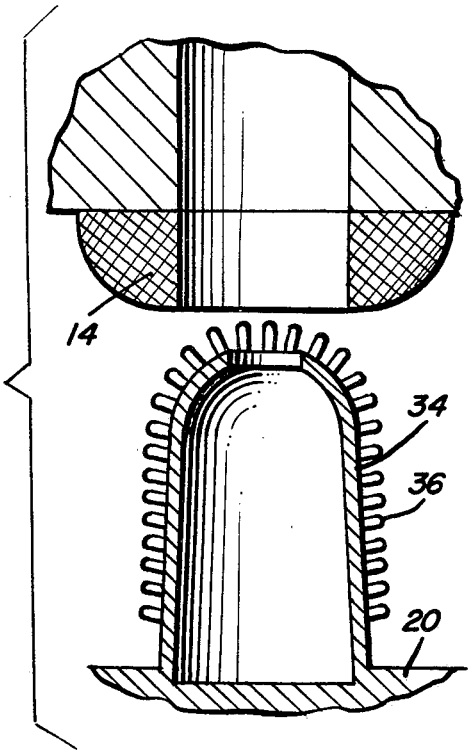
FIG. 6 is an enlarged exploded fragmentary vertical sectional view illustrating the scratch mix projection in position for frictional telescoping engagement within the recess formed in the match head.

Before the fusee is placed in use and during periods of storage the closure sleeve 18 is telescoped over the match head end of the housing 12 in the manner illustrated in FIG. 3 of the drawings and with the rib 16 engageable with the reduced diameter zones 28 and 30 to successively yieldingly resist removal of the closure sleeve 18 from the match head end of the housing 12. The cover 42 is snap fitted into position closing the opposite end of the closure sleeve 18.

When it is desired to utilize the fusee 10, the cover sleeve 18 is removed from the housing 12 and the cover 42 is removed from the cover sleeve. Thereafter, the cover sleeve 18 is reversed in position relative to the housing 12 and telescoped over the match head end thereof until the rib 16 engages the rib 38 to yieldingly prevent deeper penetration of the match head end of the housing 12 into the recess 24. Thereafter, the housing 12 is held in an inverted position by hand and struck downwardly upon a hard surface in the manner indicated as at A in FIG. 7 whereby the match head supporting end of the housing 12 will be driven downwardly into the recess 24 in the manner illustrated in FIG. 3 of the drawings in order to frictionally engage the match head 14 with the scratch mix 36 on the projection 34. This, of course, will cause the match head 14 to be ignited and the pyrotechnic material within the housing 12 to be subsequently ignited, as is conventional. Thereafter, the fusee 10 may be placed in a horizontal position as at B in FIG. 7.

It is noted that the fusee 10 may also have a supportive cradle operatively associated therewith or a support spike carried on the end of the housing 12 remote from the match head 14.

Figure 7:
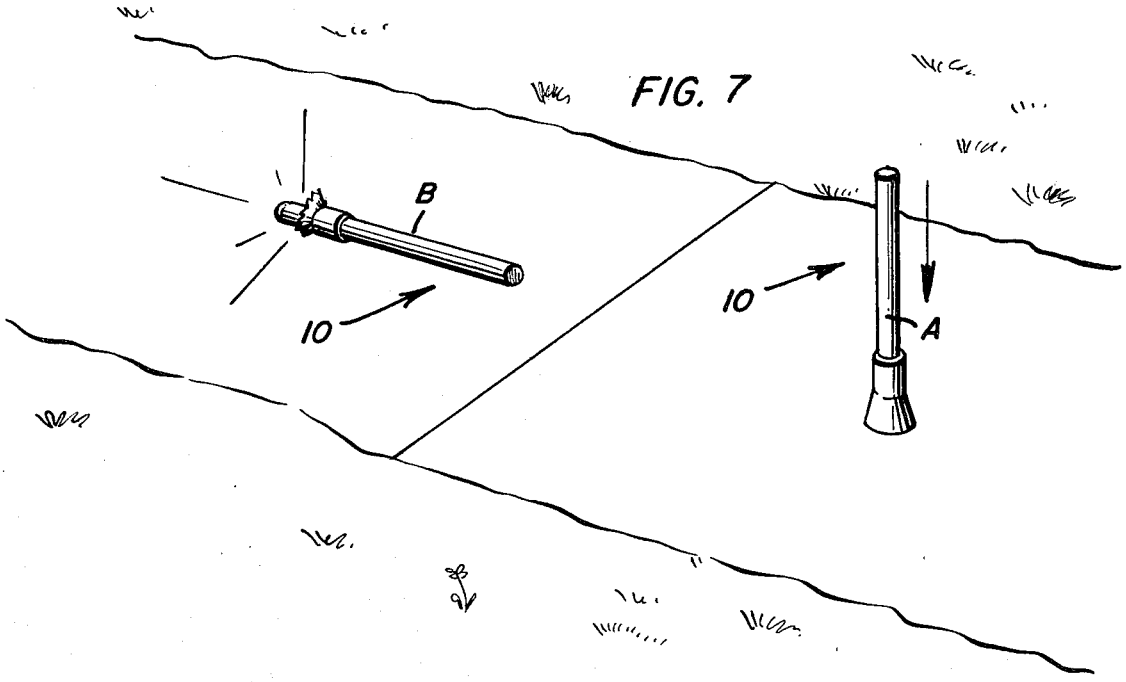
FIG. 7 comprises a perspective view illustrating the manner in which the fusee may be handled to effect ignition thereof and laid upon the ground after ignition.

During ignition of the fusee 10, the person downwardly striking the closure sleeve 18 upon a hard surface in the manner illustrated in the right-hand portion of FIG. 7 may readily grip the fusee 10 from the extreme end of the housing 12 thereof remote from the match head 14. Thus, ignition of the pyrotechnic material within the fusee 10 is effected while the hands of the user are disposed as far as possible from the initially ignited match head. Also, final manipulation of the fusee 10 to effect ignition thereof may be accomplished by only one hand and even if accidental ignition of the match head 14 occurs, initial burning of the pyrotechnic material within the housing 12 will be confined to the area of the housing 12 enclosed within the recess 24 within the closure sleeve 18 and thus a further guard against accidental burning is provided. Of course, the closure sleeve 18 is also constructed of a material which will burn away promptly after initial ignition of the pyrotechnic material.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fusee including a tubular housing containing a pyrotechnic mixture, one end of said housing including a match head defining an outwardly opening central cavity therein, a cover sleeve having a central partition therein and including opposing end recesses on opposite sides of said central partition, a scratch head mix central projection supported within one of said recesses on the corresponding side of said partition, said cover sleeve being removably telescoped over said one end with said one end telescopes into the other of said recesses and being alternately telescopingly engageable over said one end with the latter telescoped into said one recess in position for frictional telescopic engagement of said projection within said cavity to effect ignition of said head when an axial force is applied to increase the telescopic engagement of said one housing end and the end of said sleeve defining said recess.

2. The fusee of claim 1 wherein said sleeve and one end of said housing include coacting portions releasably limiting telescoping of said one of said housing into said one recess sufficient to prevent frictional engagement of said projection in said cavity.

3. The fusee of claim 1 including a cover removably engaged with and closing the end of said sleeve outwardly through which said one recess opens, said cover being spaced outwardly of said projection.

4. The fusee of claim 1 wherein said match head and sleeve include coacting portions yieldingly preventing removal of said sleeve from said one end of said housing.

5. The fusee of claim 4 wherein said sleeve and one end of said housing include coacting portions releasably limiting telescoping of said one end of said housing into said one recess sufficient to prevent frictional engagement of said projection in said cavity.

6. The fusee of claim 5 including a cover removably engaged with and closing the end of said sleeve outwardly through which said one recess opens, said cover being spaced outwardly of said projection.

7. The fusee of claim 6 wherein said cover sleeve includes projection means on the inner side thereof within said other recess, said one end of said housing including projection means thereon coacting with said projection means in said other recess to releasably retain said cover sleeve in position over said one end of said housing with the latter received in said other recess.

8. The fusee of claim 7 wherein said sleeve and one end of said housing include coacting portions releasably limiting telescoping of said one end of said housing into said one recess sufficient to prevent frictional engagement of said projection in said cavity.

9. A fusee including a tubular housing containing a pyrotechnic mixture, one end of said housing including a match head defining an outwardly opening central cavity therein, a cover sleeve having at least one open end defining a recess therein and further including a scratch head mix projection supported within said recess and projecting toward the open end of said recess, said sleeve being removably partially telescoped over said one end in a first position with said projection spaced slightly outwardly of seated engagement in said cavity, said one end said housing and sleeve including coacting portions yieldingly limiting further telescoping of said sleeve over said one end to a second position with said projection frictionally seated within said cavity to effect ignition of said head, said coacting portions being ineffective to limit said further telescoping of said sleeve over said one end to said second position in response to manually appliable force above a predetermined magnitude upon said sleeve to force the latter toward said second position.

* * * * *